US005381922A

United States Patent [19]

Gladman et al.

[11] Patent Number: 5,381,922

[45] Date of Patent: Jan. 17, 1995

[54] ARTICLE HOLDER

[76] Inventors: Neil R. Gladman, 288 Somerville Road, West Footscray Victoria 3012; Peter A. Lovel, 97 Fenton Street, Ascot Vale Victoria 3032, both of Australia

[21] Appl. No.: 40,254

[22] Filed: Mar. 30, 1993

[30] Foreign Application Priority Data

Mar. 30, 1992 [AU] Australia ..... PL1568

[51] Int. Cl.[6] ..... B62J 11/00

[52] U.S. Cl. ..... 220/481; 220/480; 220/737; 224/253

[58] Field of Search ..... 220/480, 481, 737, 482; 224/253, 269, 271, 35

[56] References Cited

U.S. PATENT DOCUMENTS

| | | | |
|---|---|---|---|
| 2,823,004 | 2/1958 | Melloh | 220/480 |
| 3,027,036 | 3/1962 | Budreck | 220/480 |
| 3,190,500 | 6/1965 | Miles | 220/480 |
| 4,345,704 | 8/1982 | Boughton | 220/737 |
| 4,535,921 | 8/1985 | Sanders | 220/480 |
| 4,860,896 | 8/1989 | Snider | 220/737 |
| 4,960,225 | 10/1990 | Gillis | 220/737 |
| 4,984,723 | 1/1991 | Hsu | 220/737 |
| 5,102,020 | 4/1992 | Walker et al. | 220/480 |
| 5,251,777 | 10/1993 | McMahon | 220/480 |

*Primary Examiner*—Joseph Man-Fu Moy

*Attorney, Agent, or Firm*—Oblon, Spivak, McClelland, Maier, & Neustadt

[57] ABSTRACT

A "no-hands" carrier for a cylindrical article comprising a clip attachable to the user's belt and a flexible cup-like holder capable of closely fitting around the article, and adhesive pads on the clip and holder respectively co-operable to form a fastening sufficient to support the weight of the holder/container and being removable by rolling the holder/container relatively to the clip.

5 Claims, 1 Drawing Sheet

ARTICLE HOLDER

BACKGROUND OF THE INVENTION

1. Field of the Invention

This invention relates to a supporting means in the form of a carrier or holder for objects such as cylindrical or part-cylindrical articles, for example metal cans or other containers of beverages and the like.

2. Discussion of the Background

Very often e.g. in outdoor, barbecue, sporting or picnic events and functions the possessor of a cylindrical, or partially cylindrical (e.g. a beverage container) article wishes to set it down so as to leave his or her hands free for other purposes such as for holding and eating a plate of food or, at a shop or outdoor kiosk where counter or bench space may be in short supply or non-existent, to handle a wallet or purse and money and change while making purchases. Thus, a convenient temporary holder for articles such as beverage containers would be most helpful.

SUMMARY OF THE INVENTION

Accordingly, one object of this invention is to provide a simple and secure carrier or holder for a can of beer or such like article of comparable size, shape and maximum weight, whereby the article can be held to the user's clothing such as a belt or trouser-top.

Other objects and advantages will become apparent hereinafter.

Accordingly, the present invention provides a carrier for supporting an article having at least a part-cylindrical surface, the article being of a kind normally held in a user's hand but required to be otherwise held to the person of the user so as to leave his hands free, consisting of a flexible cup-like holder adapted to receive the article in close-fitting relationship, and fastening means for detachably retaining the holder and any contents to the person of the user who is thereby capable of wearing the holder (and article) in a "hands-free" manner, and co-operable adhesive pads on the outside of a curved side wall portion of the holder covering said curved side wall of the article, and on an outer exposed face of the fastening means, respectively, said retention being rendered effective by placing the holder with its pad against the pad on the fastening means, and being removable by rolling the holder, with the container therein, so as progressively to reduce the mutual contact area of the pads.

BRIEF DESCRIPTION OF THE DRAWINGS

A more complete appreciation of the present invention and many of the attendant advantages thereof will become readily apparent with reference to the accompanying drawings comprising FIGS. 1 and 2 which show a practical embodiment of the invention. Specifically.

DESCRIPTION OF THE PREFERRED EMBODIMENTS

Figure 1:
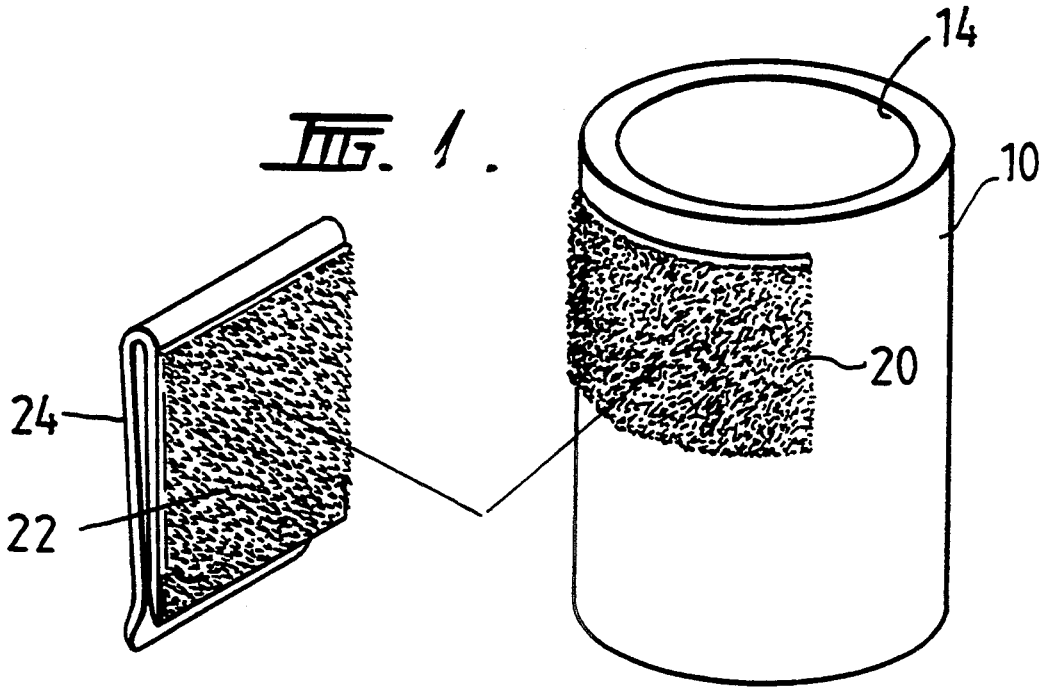
FIG. 1 is a perspective view of the invention fastening means in the form of a clip adapted to be hooked over a wearer's belt, and a can-holder capable of being held to the clip.
Figure 2:
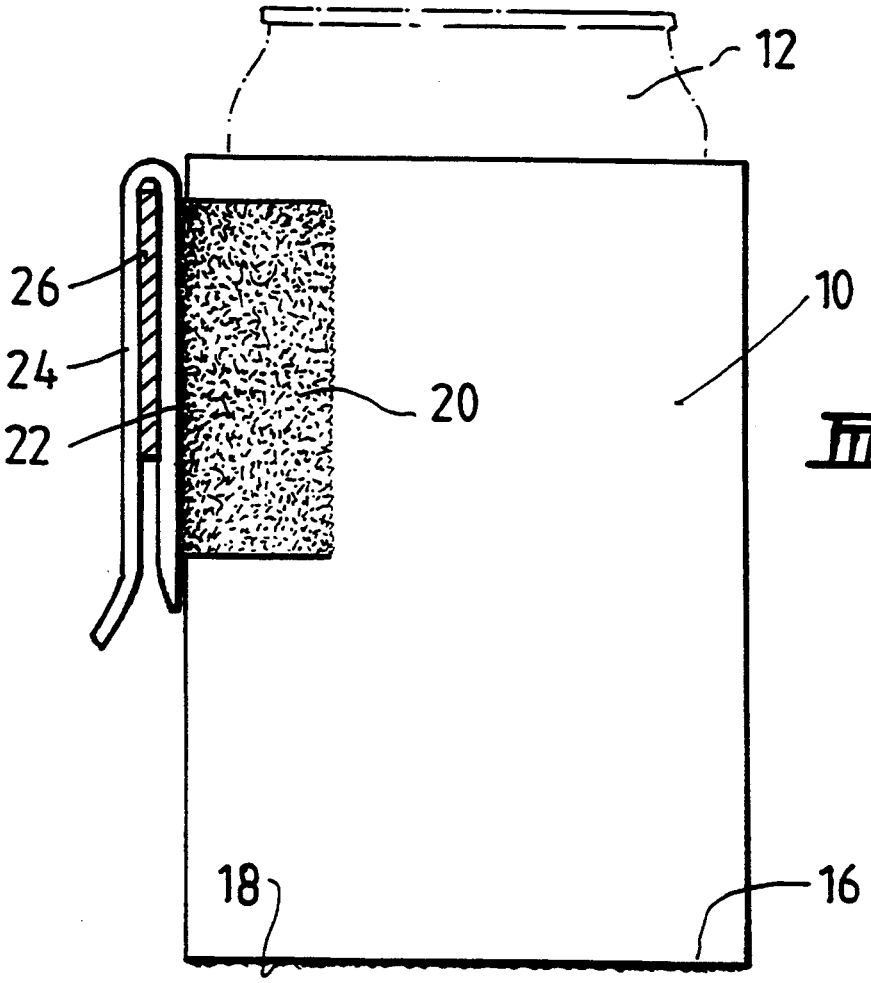
FIG. 2 is a side view with the clip secured by hooking over the belt aforesaid, the holder fastened to the clip and (in ghosted outline) the upper part of an object being carried in the holder.

Referring to the drawings in more detail, there is shown a cup-like holder pouch or receptacle 10 of flexible heat-insulating material such as NEOPRENE, for a generally cylindrical article 12 such as a metal can of beverage.

Holder 10 is advantageously made to a size to fit a standard commercial can in close-fitting relationship by sliding article 12 through open top 14 of holder 10 or, if necessary, by placing the bottom of the article into the open top portion 14, and thereafter pulling holder 10 over article 12 in the manner of a sock over a foot.

Advantageously the bottom of holder 10 is fitted with a rubber or like closure 16 to provide for the can a positive support in addition to whatever frictional grip exists between 10 and 12. Furthermore, at least the bottom of closure 16 is such as to provide for a high-friction grip surface 18 to help stabilize the holder and can when placed on a table or other possibly unsteady surface.

Holder 10 may be of a substance similar to that from which "wetsuits" are made.

Affixed to, around and/or along whole or part of the outer surface of the holder is a band or pad 20 of adhesive material such as of the "touch and close" or hooked variety put out under the trade mark VELCRO, co-operable with a complementary pad 22 attached to clip 24 adapted to fasten to the user's or wearer's clothing such as to a belt 26. The dimensions of the co-operable adhesive bands, pads or the like are such as to provide at least the minimum adhesive effect required to support the article when of maximum weight. In the case of a standard drink can this will usually be when the can is substantially full and therefore weighs of the order of 400 grams. Furthermore although, with the user or wearer standing or seated, the co-operating adhesive elements will generally be substantially vertical, their common area is advantageously sufficient to hold and support a maximum weight irrespective of orientation of the adhering areas. Thus, for example, the adhesive effect should be adequate to retain the holder and its contents (e.g. a full can) suspended beneath the clip when the latter is held above the holder/contents, when the weight force tending to break the grip acts substantially normal to the grip surface.

Advantageously the adhesive pad on the holder is a sleeve or band extending around whole or part of the periphery of the holder, and the adhesive pad on the clip may be a square or rectangular patch the "height" of which (i.e. the length measured in the direction of the generators of the cylindrical article carried by the holder) may be equal to the "height" of the pad or band on the holder.

Although the exposed face of clip 24, and pad 22 attached thereto, are shown to be flat, it may be desirable, in order to increase the efficacy of the grip, to shape them somewhat concavely provided, however, the "roll-off" action is not substantially impeded.

The holder, plus its contents, and the clip, are advantageously co-operable so that to disengage the holder (and contents) from the clip it suffices to roll the holder across the clip until there is insufficient area of contact between their respective adhesive elements to secure and retain the grip.

We have found that with suitably shaped and suitably cooperable adhesive pads or other elements, although it may be exceedingly difficult to break the grip by a simple (translational) pulling action normal to the contact area, it can be relatively easy to roll one off the other.

It is assumed, of course, that the holder, or at least part thereof, is of suitably convex formation to enable the rolling action to be effected.

This "roll-off" principle of our invention could also be applied to other purposes e.g. in a motor vehicle wherein an adhesive pad could be affixed to a dashboard or the like and a drink-can in a holder according to our invention could be attached either directly thereto or via an intermediate clip or other member having two adhesive elements, one co-operable with the dashboard pad and one with the holder itself.

For the purposes of this specification terms such as "side" "upper" "top" and "bottom" refer to the invention in a position of use and are not necessarily limiting.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A carrier for holding an article comprising:

an article holder having an opening therein for receiving at least one article, said article holder including a curved outer surface;

a mounting member separate from said article holder, said mounting member including a substantially flat surface; and fastening means for releasably fastening said article holder to said mounting member, said fastening means being arranged such that fastening between said mounting member and said article holder being progressively reduced by rotation of said article holder relative to said flat surface, said fastening means including first and second fastener parts, said first fastener part mounted upon said outer curved surface of said article holder and said second fastener part mounted upon said substantially flat surface of said mounting member.

2. The carrier of claim 1, wherein said first and second fastener parts together comprise a hook and loop fastener.

3. The carrier of claim 1, wherein said article holder is formed of a flexible heat-insulating material, and said opening is in the form of a cavity having a cylindrical shape of a substantially constant cross-section extending from a mouth of said opening and through at least a substantial portion of said article holder.

4. The carrier of claim 1, wherein said mounting member comprises a clip having means to attach said clip to human clothing.

5. A carrier for holding an article, comprising:

an article holder having an opening therein for receiving at least one article, said article holder having an outer surface at least part of which is cylindrically convex;

a mounting member separate from said article holder, said mounting member having an outer surface at least part of which is flat;

first and second cooperating fastener parts together comprising a variable-area hook and loop fastener for releasably fastening said article holder to the mounting member, said first fastener part being mounted upon said cylindrically convex outer surface part of said article holder and said second fastener part being mounted upon said flat outer surface part of said mounting member;

said fastener area being progressively reducible by rolling the article holder over the mounting member.

* * * * *